US012276075B1

(12) United States Patent
Oh et al.

(10) Patent No.: US 12,276,075 B1
(45) Date of Patent: Apr. 15, 2025

(54) TURNING EARTH ANCHOR STRUCTURE FOR SUPPRESSING TOP DISPLACEMENT, AND TWO-ROW SELF-SUPPORTING TEMPORARY EARTH RETAINING STRUCTURE HAVING A MANUAL RESISTOR BLOCK

(71) Applicant: Yong Hwan Oh, Gyeonggi-do (KR)

(72) Inventors: Yong Hwan Oh, Gyeonggi-do (KR); Woo Yeul Baek, Seoul (KR)

(73) Assignee: Yong Hwan Oh, Gyeonggi-Do (KR)

( * ) Notice: Subject to any disclaimer, the term of this patent is extended or adjusted under 35 U.S.C. 154(b) by 0 days.

(21) Appl. No.: 18/860,221

(22) PCT Filed: Sep. 10, 2024

(86) PCT No.: PCT/KR2024/013677
§ 371 (c)(1),
(2) Date: Oct. 25, 2024

(87) PCT Pub. No.: WO2025/058364
PCT Pub. Date: Mar. 20, 2025

(30) Foreign Application Priority Data

Sep. 12, 2023 (KR) ..... 10-2023-0121172

(51) Int. Cl.
*E02D 29/02* (2006.01)

(52) U.S. Cl.
CPC ..... *E02D 29/0266* (2013.01); *E02D 29/0233* (2013.01); *E02D 2600/30* (2013.01)

(58) Field of Classification Search
CPC ..... E02D 29/0266; E02D 29/0233; E02D 2600/30
See application file for complete search history.

(56) References Cited

FOREIGN PATENT DOCUMENTS

| | | | |
|---|---|---|---|
| KR | 10-2010-0094139 | A | 8/2010 |
| KR | 10-1949086 | B1 | 2/2019 |
| KR | 102315422 | B1 * | 10/2021 |
| KR | 10-2023-0030555 | A | 3/2023 |
| KR | 10-2023-0057055 | A | 4/2023 |

* cited by examiner

*Primary Examiner* — Kyle Armstrong
(74) *Attorney, Agent, or Firm* — The PL Law Group, PLLC

(57) ABSTRACT

A two-row self-supporting earth retaining wall structure includes an upper displacement restraining tea structure and an excavated subsoil passive resistance block body. Piles having a two-row structure, waling members, and guide brackets, which are improved in shape, may be used to directly apply tension to the rear waling member and the front waling members, thereby improving bearing capacity of the waling members due to an earth pressure of backfill soil and improving stability of the two-row self-supporting earth retaining temporary structure. In addition, since the front pile is disposed to be spaced a predetermined distance from the rear pile, the gravity retaining wall may be provided between the front pile and the rear pile, and the gravity retaining wall may further improve the stability of the two-row self-supporting earth retaining temporary facility while supporting the backfill earth pressure between the front piles and the rear piles.

8 Claims, 16 Drawing Sheets

TURNING EARTH ANCHOR STRUCTURE FOR SUPPRESSING TOP DISPLACEMENT, AND TWO-ROW SELF-SUPPORTING TEMPORARY EARTH RETAINING STRUCTURE HAVING A MANUAL RESISTOR BLOCK

BACKGROUND

1. Technical Field

The present invention relates to a two-row self-supporting earth retaining wall structure having an upper displacement restraining TEA structure and an excavation subsoil passive resistance block body, and more particularly, to a technology for increasing in excavation self-supporting height and improving stability of a self-supporting earth retaining temporary structure in soft ground.

2. Background Art

Generally, at civil engineering or building construction sites, temporary earth-retaining structures are installed to prevent soil disposed at a rear side of excavated soil (i.e., backfill soil) from being introduced into the soil to be excavated (i.e., excavated soil). The temporary earth-retaining structures may be made of thumb piles, earthen plates, wales, struts, etc., and prevent a space to be excavated from collapsing due to an earth pressure of the backfill soil.

Various earth-retaining methods, such as earth anchors and C.I.P., are used as earth-retaining methods to construct temporary earth-retaining structures. However, there are problems that conventional earth-retaining methods either have difficulty effectively applying tensile force to the pile, or require complex structures and excessive construction cost to directly apply the tensile force to the pile, and thus, self-supporting earth retaining methods that are capable of supporting an earth pressure and a water pressure using only piles themselves are widely used. In the case of the self-supporting earth retaining methods, it is very important to increases in excavation height and ensure the stability of the earth retaining wall, especially in the soft ground such as sedimentary layers, alluvium layers, and landfill layers.

SUMMARY

The present invention is to improve bearing capacity of a waling member due to a soil pressure of backfill soil, thereby improving stability of a two-row self-supporting temporary earth retaining structure.

According to an exemplary embodiment, a two-row self-supporting earth retaining wall structure includes: a plurality of rear piles (10) spaced a predetermined interval from backfill soil while adjacent to the backfill soil and installed vertically with respect to the ground; a rear waling member (20) disposed adjacent to the plurality of rear piles (10) in a direction perpendicular to the plurality of rear piles (10) at an upper portion of the ground, which is first-stage excavated, after the first-stage excavation is performed to a predetermined depth at an opposite side of the backfill soil; a first guide bracket (40) coupled to the rear waling member (20) and configured to change a wiring direction of a plurality of first tensile materials (30) to a direction perpendicular to a longitudinal direction of the rear pile (10) so that the first tensile materials (30) are guided to pass through the rear waling member (20); a plurality of front piles (50) spaced a predetermined interval from the plurality rear piles (10) and installed vertically with respect to the first-stage excavated ground; a first front waling member (60) disposed adjacent to the plurality of front piles (50) in a direction perpendicular to the plurality of front piles (50) at an upper side of the first-stage excavated ground; a second guide bracket (70) coupled to the first waling member (60) to guide the plurality of first tensile materials (30) so as to pass through the first waling member (60) and to fix the first tensile materials (30) that passes through the first front waling member (60); a second front waling member (90) disposed adjacent to the plurality of front piles (50) in a direction perpendicular to the plurality of front piles (50) at an upper side of the second-stage excavated ground after the second-stage excavation is completed to a depth deeper than that of the first-stage excavation to a lower side of the first front waling member (60) in a state in which one end of each of the first tensile materials (30) is tensioned; and a third guide bracket (110) coupled to the second front waling member (90) to change a wiring direction of a plurality of second tensile materials (100) to a direction perpendicular to a longitudinal direction of each of the front piles (50) so that the second tensile materials (100) are guided to pass through the second front waling member (90), wherein each of the plurality of first tensile materials (30) has one end, which passes through the second guide bracket (70) to protrudes to a front surface of the second guide bracket (70), and the other end fixed to a lower portion of the ground, and the one end of each of the first tensile materials (30) is tensioned in the state in which the other end of each of the first tensile materials (30) is fixed to the lower portion of the ground.

A gap maintaining member (80) configured to support the rear waling member (20) and the first front waling member (60) so as to maintain a gap between the rear waling member (20) and the first front waling member (60) may be disposed between the rear waling member (20) and the first waling member (60), the gap maintaining member (80) may be provided in an H-beam shape constituted by a plurality of flanges (81) and a web (82), and the plurality of first tensile materials (30) may be wired along a longitudinal direction of the web (82) in a state of being seated on a top surface of the web (82) to pass through the first front waling member (60).

The two-row self-supporting earth retaining wall structure may further include: a second front waling member (90) disposed adjacent to the plurality of front piles (50) in a direction perpendicular to the plurality of front piles (50) at an upper side of the second-stage excavated ground after the second-stage excavation is completed to a depth deeper than that of the first-stage excavation to a lower side of the first front waling member (60) in a state in which one end of each of the first tensile materials (30) is tensioned; and a third guide bracket (110) that is coupled to the second front waling member (90) to change the wiring direction of the plurality of second tensile materials (100) to a direction perpendicular to a longitudinal direction of each of the front piles (50) so that the second tensile materials (100) pass through the second front waling member (90).

Each of the plurality of second tensile materials (100) may have one end, which passes through the second front waling member (90) to protrude, and the other end fixed to a lower portion of the first-stage excavated ground, and one end of each of the second tensile materials (100) may be tensioned in the state in which the other end of each of the second tensile materials (100) is fixed to the lower portion of the first-stage excavated ground.

Each of the second front waling member (90) and the third guide bracket (110) may be disposed at an upper portion of an (N-th)-stage excavated ground whenever (N-th)-stage excavation is completed to a depth deeper than that of the second-stage excavated ground to a lower side of the second front waling member (90).

The other end of the first tensile material (30) and the other end of the second tensile material (100) may be grouted to fixed inside a soil cement wall (SCW).

The other end of the first tensile material (30) and the other end of the second tensile material (100) may be fixed by a first ground anchor (202) and a second ground anchor (204), respectively.

The rear waling member (20) may include: an upper waling member (22); and a lower waling member (24) disposed to be spaced a predetermined interval from the upper waling member (22) at a lower side of the upper waling member (22), wherein the first guide bracket (40) may include: a pair of side plates (41) spaced a predetermined interval from each other between the upper waling member (22) and the lower waling member (24) to support the upper waling member (22) and the lower waling member (24), respectively; a first vertical plate (42) disposed perpendicular to the pair of side plates (41) and provided with a rotating plate (43) protruding on one surface thereof to change the wiring direction of the first tensile material (30) to the direction perpendicular to the longitudinal direction of the rear pile (10); and a second vertical plate (44) disposed parallel to the first vertical plate (42) so that the first tensile material (30) is guided toward the first front waling member (60).

A protrusion (45) configured to maintain a gap between the upper waling member (22) and the lower waling member (24) may protrude from each of both side surfaces of the side plate (41), and a pair of grooves (45*a*) in which the upper waling member (22) and the lower waling member (24) are seated, respectively, may be defined in top and bottom surfaces of the protrusion (45).

A plurality of holes (46) through which the first tensile material (30) passes may be defined in one surface of each of the first vertical plate (42) and the second vertical plate (44).

A passive resistance block body (300) disposed adjacent to the front pile (50) to support the front pile (50) is grouted to be fixed may be disposed at a lower portion of the front pile (50).

According to another exemplary embodiment, a method for constructing the above-described two-row self-supporting earth retaining wall structure includes: installing the plurality of rear piles (10); installing the rear waling member (20) and the first guide bracket (40) after the first-stage evacuation is completely performed to a predetermined depth at an opposite side of the backfill soil; installing the plurality of front piles (50); installing the front waling member (60) and the second guide bracket (70); installing a gap maintaining part (80); wiring and fixing the plurality of first tensile materials (30); tensioning the plurality of first tensile materials (30); installing the second front waling member (90) and the third guide bracket (110) after the second-stage excavation is completed to a depth deeper than that of the first-stage excavation to a lower side of the first front waling member (60); wiring and fixing the plurality of second tensile materials (100); tensioning the second tensile materials (100); and performing an (N-th)-stage excavation to a depth deeper than that of the second-stage excavated ground to a lower side of the second front waling member (90).

According to the embodiments of the present invention, the piles 10 and 50 having the two-row structure, the waling members 20, 60, and 90, and the guide brackets 40, 70, and 110, which are improved in shape, may be used to directly apply the tension to the rear waling member 20 and the front waling members 60 and 90, thereby improving the bearing capacity of the waling members 20, 60, and 90 due to the earth pressure of the backfill soil and improving the stability of the two-row self-supporting earth retaining temporary structure 1. In addition, since the front pile 50 is disposed to be spaced a predetermined distance from the rear pile 10, the gravity retaining wall may be provided between the front pile 50 and the rear pile 10, and the gravity retaining wall may further improve the stability of the two-row self-supporting earth retaining temporary facility 1 while supporting the backfill earth pressure between the front piles 50 and the rear piles 10.

Particularly, the first guide bracket 40 and the third guide bracket 110, each of which has the improved structure and shape, may be used to provide the gap through which the tensile materials 30 and 100 pass while more stably supporting the upper waling member 22 and the lower waling member 24 and also guide the wiring direction of the tensile materials 30 and 100, thereby more improving the stability of the two-row self-supporting earth retaining temporary structure 1. The stability improvement effect of the two-row self-supporting temporary earth retaining structure 1 may be more noticeable in the soft ground such as the sedimentary layers, the alluvial layers, and the landfill layers.

DETAILED DESCRIPTION

Hereinafter, specific embodiments of the present invention will be described with reference to the drawings. The following detailed descriptions are provided to help comprehensive understanding of a method, an apparatus, and/or a system described in this specification. However, this is merely an example, and the present invention is not limited thereto.

In descriptions of embodiments of the present invention, detailed descriptions related to the well-known technologies will be ruled out in order not to unnecessarily obscure subject matters of the present invention. Also, terms used in the present specification are terms defined in consideration of functions according to embodiments, and thus the terms may be changed according to the intension or usage of a user or operator. Therefore, the terms should be defined on the basis of the overall contents of this specification. The terms used in the present specification are merely used to describe particular embodiments, and are not intended to limit the present invention. An expression used in the singular encompasses the expression in the plural, unless it has a clearly different meaning in the context. In the present specification, it is to be understood that terms such as "including" or "having", etc., are intended to indicate the existence of the features, numbers, steps, actions, components, parts, or combinations thereof disclosed in the specification, and are not intended to preclude the possibility that one or more other features, numbers, steps, actions, components, parts, or combinations thereof may exist or may be added.

Figure 1:
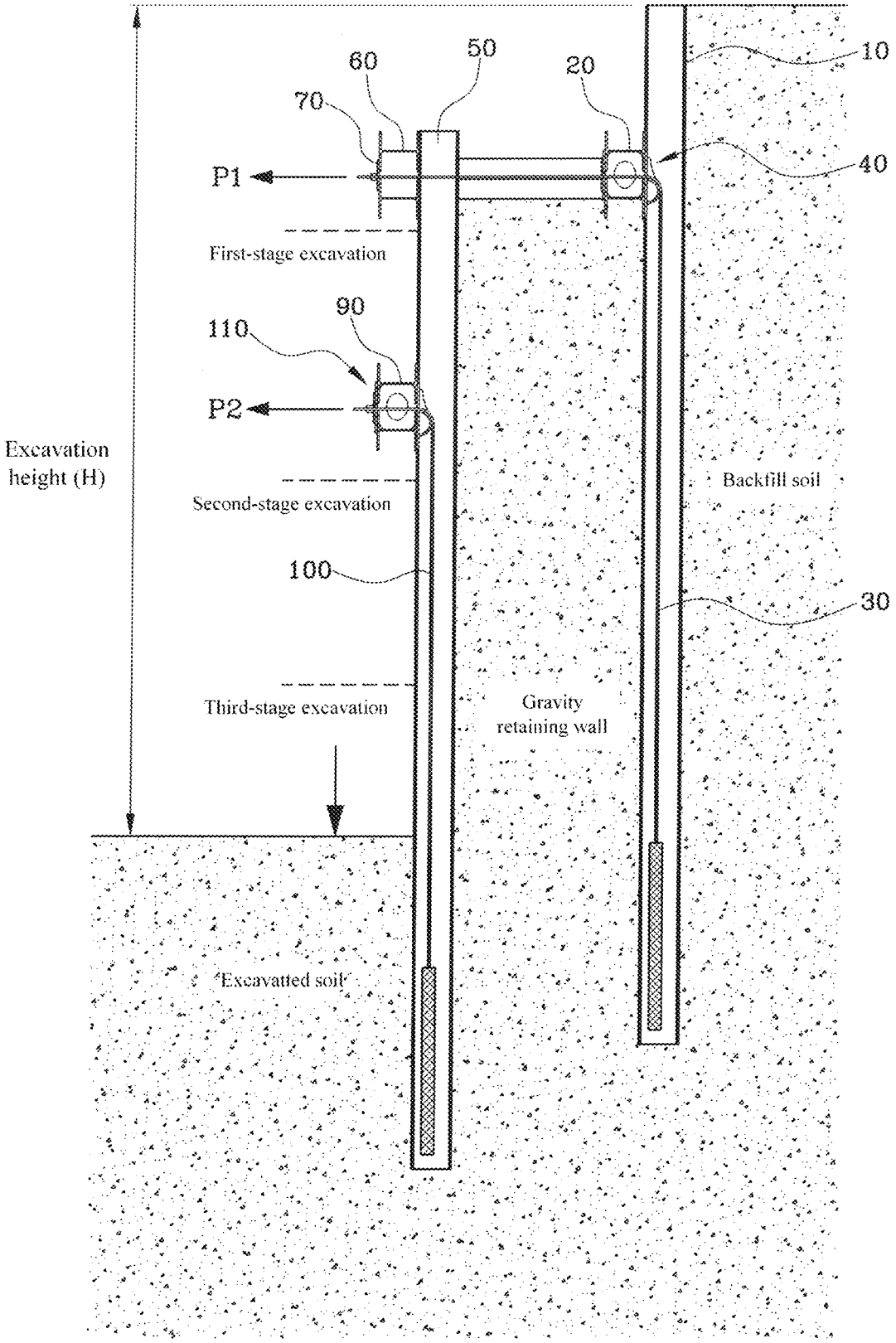
FIG. 1 is a side view of a two-row self-supporting temporary earth retaining structure according to an embodiment of the present invention.
Figure 2:
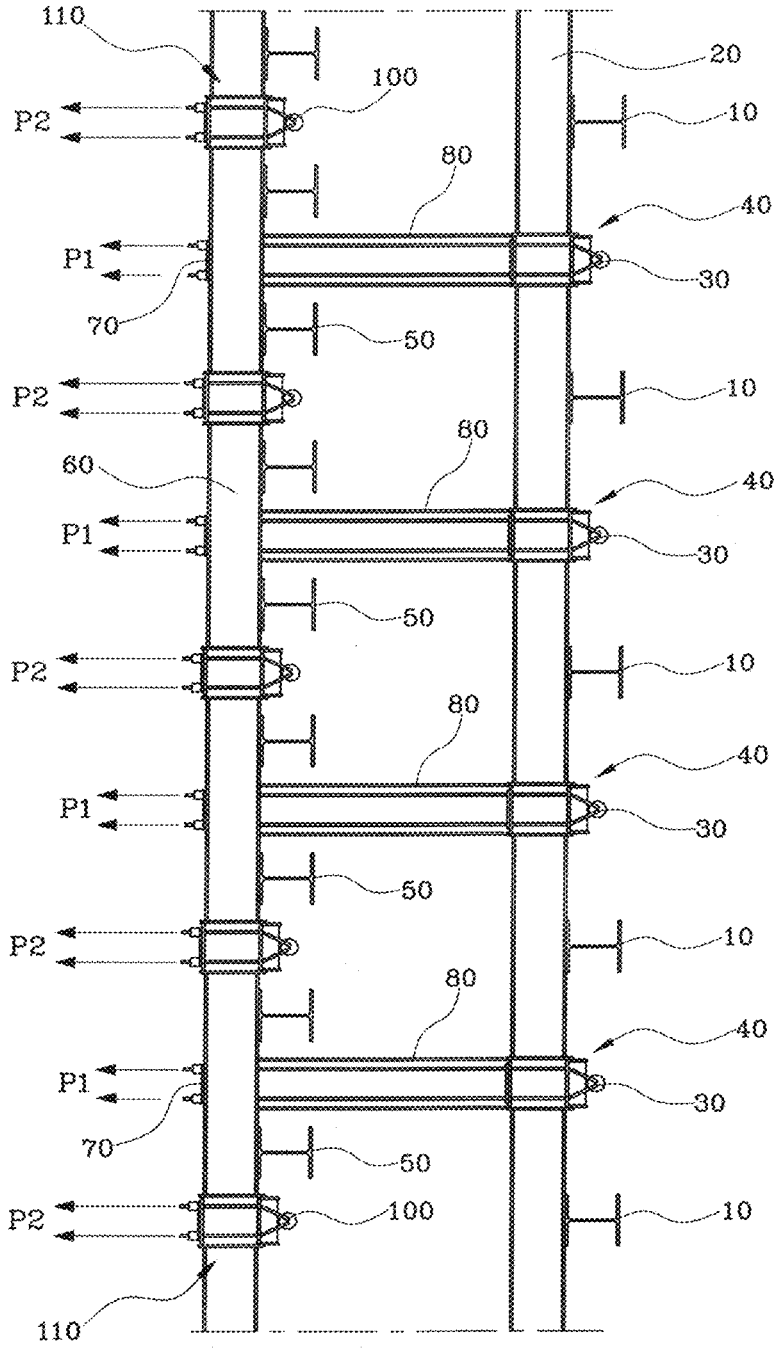
FIG. 2 is a plan view of the two-row self-supporting temporary earth retaining structure according to an embodiment of the present invention.
Figure 3:
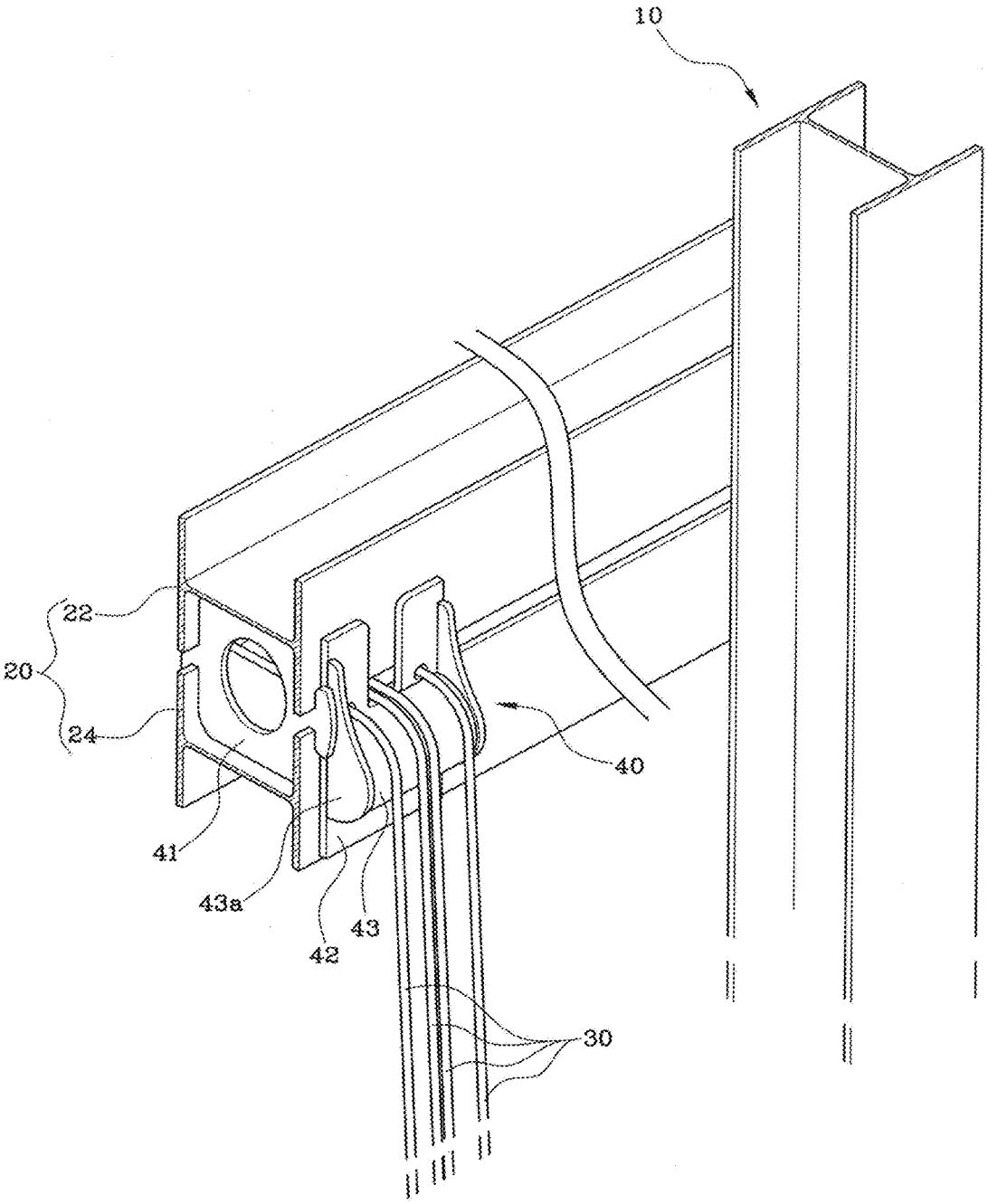
FIG. 3 is a view for explaining an installation structure of a rear pile, a rear waling member, and a first guide bracket according to embodiments of the present invention.

FIG. 1 is a side view of a two-row self-supporting temporary earth retaining structure 1 according to an embodiment of the present invention, and FIG. 2 is a plan view of the self-supporting temporary earth two-row retaining structure 1 according to an embodiment of the present invention. In addition, FIG. 3 is a view for explaining an installation structure of a rear pile 10, a rear waling member 20, and a first guide bracket 40 according to embodiments of the present invention.

As illustrated in FIGS. 1 and 2, the two-row self-supporting temporary earth retaining structure 1 according to an embodiment of the present invention may be a facility for preventing backfill soil from being introduced toward excavated soil at a construction site and may include a rear pile 10, a rear waling member 20, a first tensile material 30, a first guide bracket 40, a front pile 50, a first front waling member 60, a second guide bracket 70, a gap maintaining part 80, a second waling member 90, a second tensile material 100, and a third guide bracket 110. In this embodiments, the excavated soil refers to soil excavated by an excavator for underground work at a construction site, and the backfill soil refers to soil disposed at a rear side of the excavated soil and supported by the two-row self-supporting earth retaining temporary structure 1.

The rear pile 10 is installed vertically to the ground while being adjacent to the backfill soil. The rear pile 10 is provided in an H-beam shape and includes a plurality of flanges and webs. Here, one of the plurality of flanges (a first flange) may be disposed to face the backfill soil, and the other flanges (a second flange) may be disposed to face the excavated soil. In addition, the rear pile 10 may be installed in plurality to be spaced a predetermined interval from each other. Specifically, after the ground is perforated to a predetermined size, the rear piles 10 may be installed at a predetermined interval within the perforation. As described below, concrete may be injected into the perforation, and thus, the rear pile 10 may provide a retaining wall (i.e., SCW wall) as a stress agent.

The rear waling member 20 is disposed adjacent to the plurality of rear piles 10 in a direction perpendicular to the plurality of rear piles 10 at an upper side of the first-stage excavated ground after the first stage of excavation has been completed at a predetermined depth at an opposite side of the backfill soil. Specifically, after the rear pile 10 is installed, the first stage of excavation to a predetermined depth may be performed by an excavator at the opposite side of the backfill soil, that is, at a side of the second flange of the rear pile 10. Thereafter, the rear waling member 20 may be installed to be perpendicular to the plurality of rear piles 10 at the upper side of the first-stage excavated ground (i.e., above the first-stage excavated ground).

As illustrated in FIG. 3, the rear waling member 20 may be constituted by an upper waling member 22 and a lower waling member 24. Here, each of the upper waling member 22 and the lower waling member 24 is provided in an H-beam shape and includes a plurality of flanges and webs. The lower waling member 24 may be disposed at a predetermined distance from the upper waling member 22 at a lower side of the upper waling member 22.

The first guide bracket 40 is coupled to the rear waling member 20 to change a wiring direction of the plurality of first tensile materials 30 to a direction perpendicular to a longitudinal direction of the rear pile 10, thereby guiding the first tensile materials 30 to pass through the rear waling member 20.

As illustrated in FIGS. 1 to 3, the first tensile material 30 is wired along the longitudinal direction of the rear pile 10, and then, the wiring direction may be changed to a direction perpendicular to the longitudinal direction of the rear pile 10 as it passes through the first guide bracket 40. Here, the first tensile material 30 may be provided in plurality, and thus, tension by the first tensile material 30 may be maximized. The detailed configuration of the first guide bracket 40 will be described in detail later with reference to FIGS. 4 to 8.

The front pile 50 is spaced a predetermined interval from the plurality of rear piles 10 and is installed vertically with respect to the first-stage excavated ground. Each of the front piles 50 is provided in an H-beam shape and includes a plurality of flanges and webs. Here, one of the plurality of flanges (a first flange) may be disposed to face the rear pile 10, and the other flanges (a second flange) may be disposed to face the excavated soil. In addition, the front piles 50 may be installed in plurality to be spaced a predetermined interval from each other. Specifically, after ground is a the perforated to predetermined size, the front piles 50 may be installed at a predetermined interval within the perforation. As described below, concrete may be injected into the perforation, and thus, the front pile 50 may provide an earth retaining wall (i.e., SCW wall) as a stress agent.

Referring to FIG. 2, the front pile 50 does not need to be disposed parallel to the rear pile 10 in the same line. In addition, a distance between the plurality of front piles 50 may be less than that between the plurality of rear piles 10. That is, each of the front piles 50 may be disposed to be spaced a predetermined interval from the adjacent rear piles 10, but may be disposed to be misaligned with each other.

In addition, referring to FIG. 1, since the front pile 50 is disposed to be spaced a predetermined interval from the rear pile 10, the gravity retaining wall is provided between the front pile 50 and the rear pile 10. The gravity retaining wall may support the backfill earth pressure between the front pile 50 and the rear pile 10, and thus, the stability of the two-row self-supporting earth retaining temporary structure 1 may be further improved.

The first front waling member 60 is disposed adjacent to the plurality of front piles 50 in the direction perpendicular to the front piles 50 at the upper side of the first-stage excavated ground. Specifically, after the front piles 50 are installed, the first front waling member 60 may be installed in the direction perpendicular to the plurality of front piles 50 at the opposite side of the backfill soil, that is, at the upper side of the first-stage excavated ground (i.e., above the first-stage excavated ground) at a side of the second flanges of the front piles 50.

The first front waling member 60 is provided in an H-beam shape, similar to the rear waling member 20, and includes a plurality of flanges and webs. That is, the first front waling member 60 may be provided in the same shape as the rear waling member 20. The first front waling member 60 may be installed parallel to the rear waling member 20 at the same height as the rear waling member 20. The first front waling member 60 may include a first flange at a side of the backfill soil and a second flange at a side of the excavated soil, and the first flange of the first front waling member 60 may be disposed to face the flange at the side of the excavated soil of the rear waling member 20.

The second guide bracket 70 is coupled to the first front waling member 60 to guide a plurality of first tensile materials 30 so as to pass through the first front waling member 60, thereby fixing the first tensile materials 30 that pass through the first front waling member 60.

As illustrated in FIGS. 1 and 2, the second guide bracket 70 may be provided in a plate shape having a predetermined size and may be coupled to the first front waling member 60. As described later, the second guide bracket 70 may be provided with a plurality of holes through which the first tensile material 30 passes, and the first tensile material 30 may pass through the first front waling member 60 through the holes to pass through the second guide bracket 70. In addition, a fixing member for fixing the first tensile material 30 may be provided in the hole of the second guide bracket 70.

The gap maintaining part 80 is disposed between the rear waling member 20 and the first front waling member 60 to support each of the rear waling member 20 and the first front waling member 60, thereby maintaining a gap between the rear waling member 20 and the first front waling member 60. As described later, the gap maintaining part 80 may be provided in an H-beam shape, and the first tensile material 30 may be seated and wired on a top surface of the web of the gap maintaining part 80. The first tensile material 30 may be wired along a longitudinal direction of the web while being seated to the top surface of the web to pass through the first front waling member 60.

The plurality of first tensile materials 30 wired as described above may have one end, which passes through the second guide bracket 70 to protrude to a front surface of the second guide bracket 70, and the other end fixed to a lower portion of the ground. Here, the other end of the first tensile material 30 may be disposed below the perforation, in which the above-described rear pile 10 is installed, and may be fixed by injecting concrete into the perforation. That is, the other end of the first tensile material 30 may be fixed to be integrated with the earth retaining wall during the process of forming the earth retaining wall using the rear pile 10 as the stress agent. The fixing method is called an SCW (soil cement wall) rear fixing manner.

One end of the first tensile material 30 may be tensioned by a hydraulic device (not shown) in the state in which the other end of the first tensile material 30 is fixed. (See P1 in FIG. 1)

The second front waling member 90 may be provided adjacent to the plurality of front piles 50 in the direction perpendicular to the plurality of front piles 50 at the upper side of the second-stage excavated ground after completely excavating the ground at a depth deeper than that of the first-stage excavated ground to the lower side of the first front waling member 60 in the state in which one end of the first tensile material 30 is tensioned. Specifically, after one end of the first tensile material 30 is tensioned, the second-stage excavation may be performed to the lower side of the first front waling member 60 by the excavator. When the second-stage excavation is completed, the second front waling member 90 may be installed in the direction perpendicular to the plurality of front piles 50 at the upper side of the second-stage excavated ground. The second front waling member 90 has the same structure and shape as the rear waling member 20 described above.

A third guide bracket 110 is coupled to the second front waling member 90 to change a wiring direction of the plurality of second tensile materials 100 to a direction perpendicular to a longitudinal direction of the front pile 50, thereby guiding the second tensile materials 100 to pass through the second front waling member 90.

As illustrated in FIGS. 1 to 2, the second tensile material 100 is wired along the longitudinal direction of the front pile 50, and then, the wiring direction may be changed to a direction perpendicular to the longitudinal direction of the front pile 50 as it passes through the third guide bracket 100. Here, the second tensile material 100 may be provided in plurality, and thus, tension by the second tensile material 100 may be maximized. The third guide bracket 110 has the same structure and shape as the first guide bracket 40 described above. That is, the second front waling member 90 and the third guide bracket 110 are configured as the same as the rear front waling member 20 and the first guide bracket 40 described above, respectively, and the second tensile material 100 may also have the same wiring direction as the first tensile material 30.

As described above, the second tensile material 100 may have one end, which passes through the second front waling member 90 via the third guide bracket 110 to protrude to a front surface of the third guide bracket 110, and the other end fixed to the lower portion of the ground that is first-stage excavated. Here, the other end of the second tensile material 100 may be disposed below the perforation, in which the front pile 50 is installed, and may be fixed by injecting concrete into the perforation. That is, the other end of the second tensile material 100 may be fixed to be integrated with the earth retaining wall during the process of forming the earth retaining wall using the front pile 50 as the stress agent. The other end of the second tensile material 100 is fixed in the same manner as the other end of the first tensile material 30, and the fixing method is referred to as the SCW front fixing manner. The other end of the first tensile material 30 and the other end of the second tensile material 100 may be grouted and fixed inside the SCW wall (i.e., the earth retaining wall).

Thereafter, (N-th)-stage excavation (N>2) that is deeper than that of the 2-stage excavated ground may be performed to a lower side of the second front waling member 90 (for example, 3-stage excavation, 4-stage excavation, etc.), and whenever the (N-th)-stage excavation is completed, the second front waling member 90 and the third guide bracket 110 may be installed in the same manner as described above at the upper side of the (N-th)-stage excavated ground. That is, the second front waling member 90 and the third guide bracket 110 may be repeatedly installed along a longitudinal direction of the second front waling member 90 whenever the (N-th)-stage excavation is completed, and the second tensile material 100 may also be wired and tensioned through each of the second front waling members 90 and the third guide bracket 110. The (N-th)-stage excavation may be performed until the excavation depth reaches a target depth.

Figure 4:
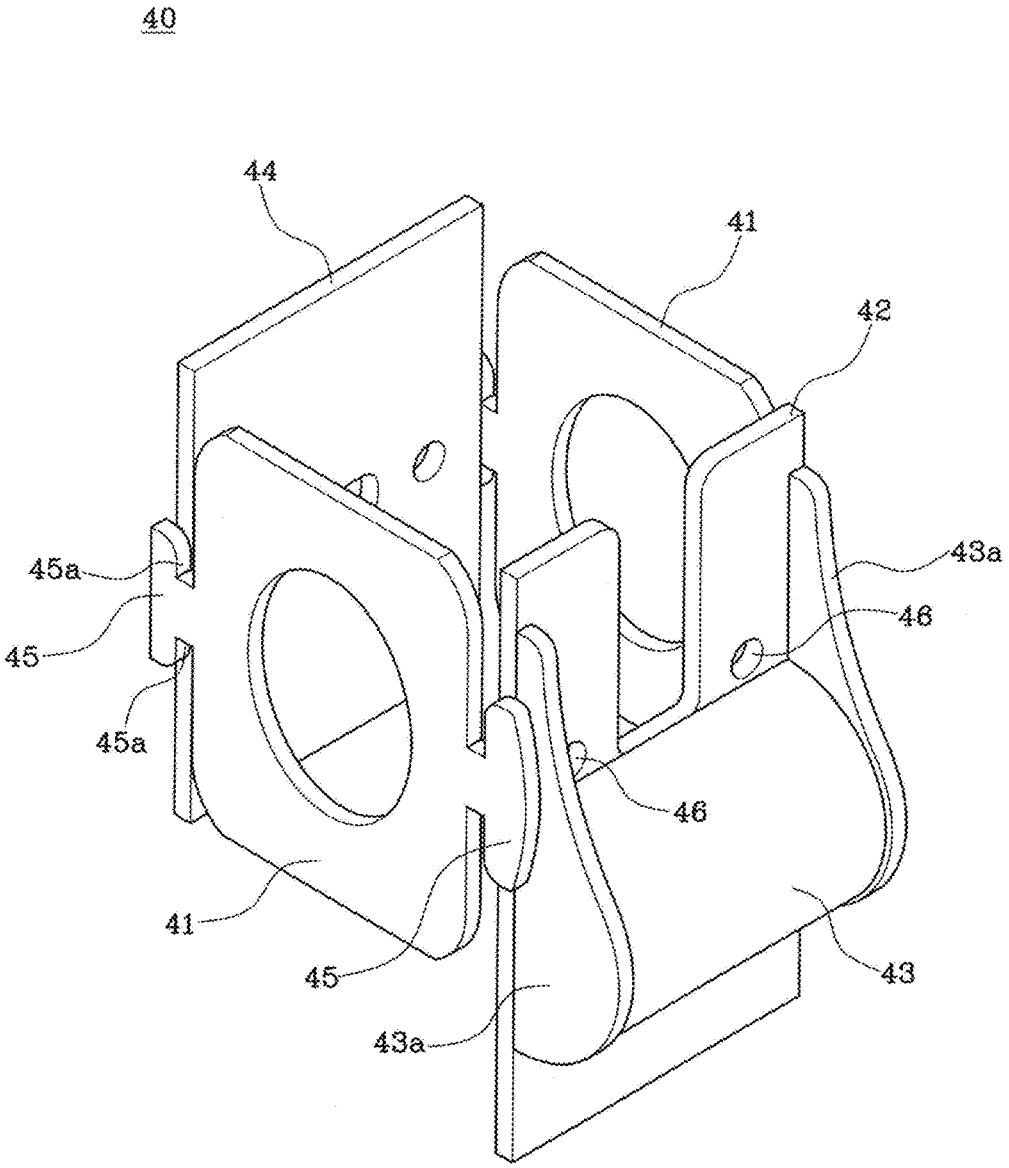
FIG. 4 is a perspective view of the first guide bracket according to embodiments of the present invention.
Figure 5:
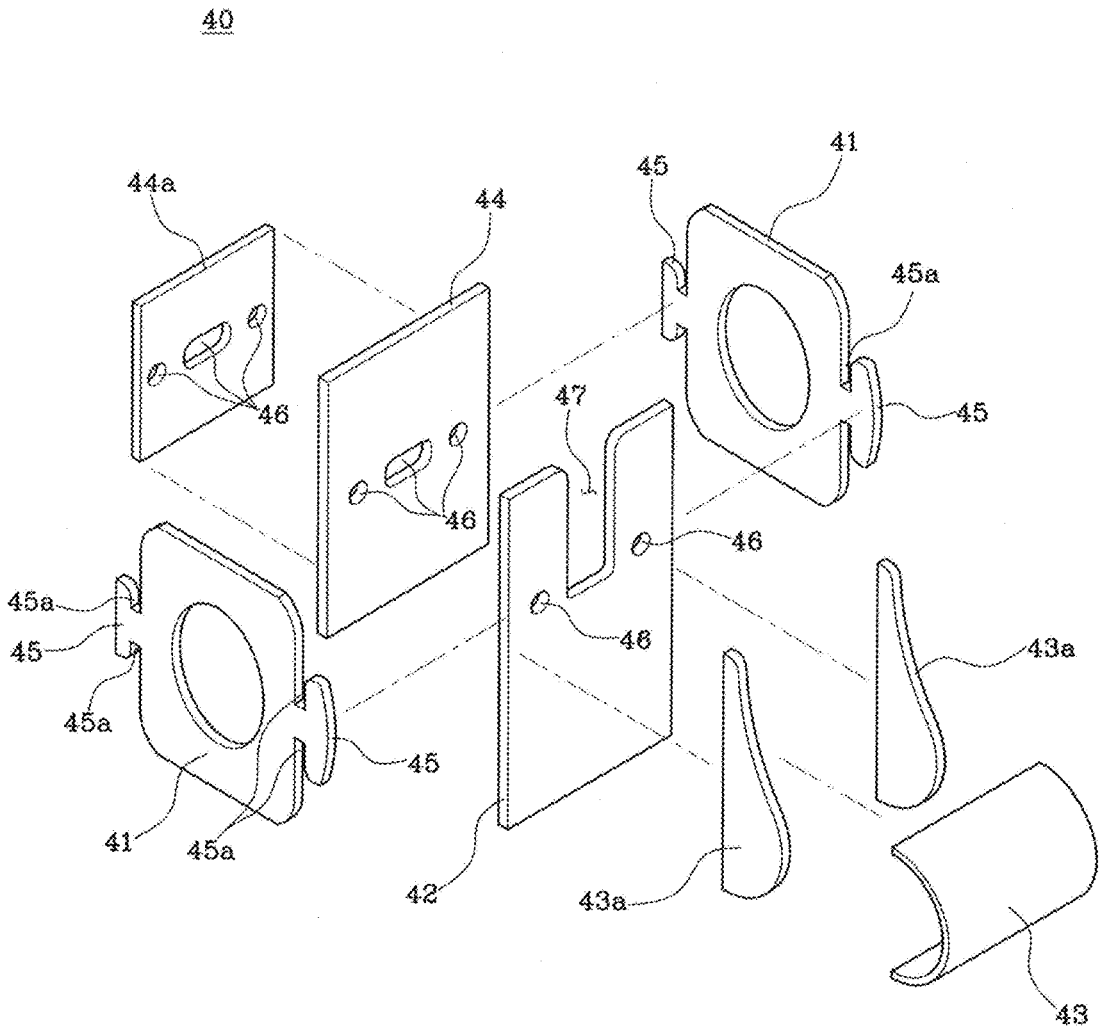
FIG. 5 is an exploded view of the first guide bracket according to embodiments of the present invention.
Figure 6:
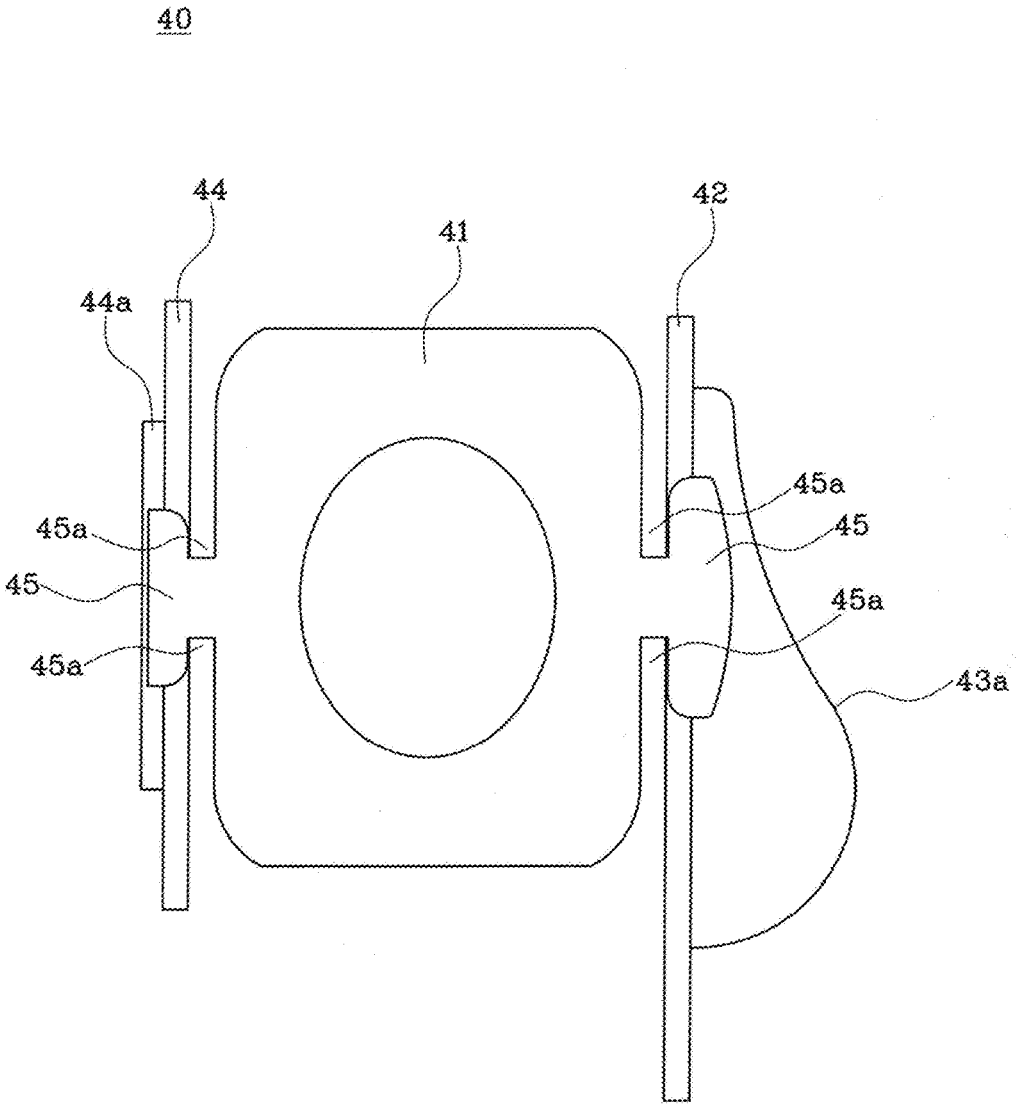
FIG. 6 is a side view of the first guide bracket according to embodiments of the present invention.
Figure 7:
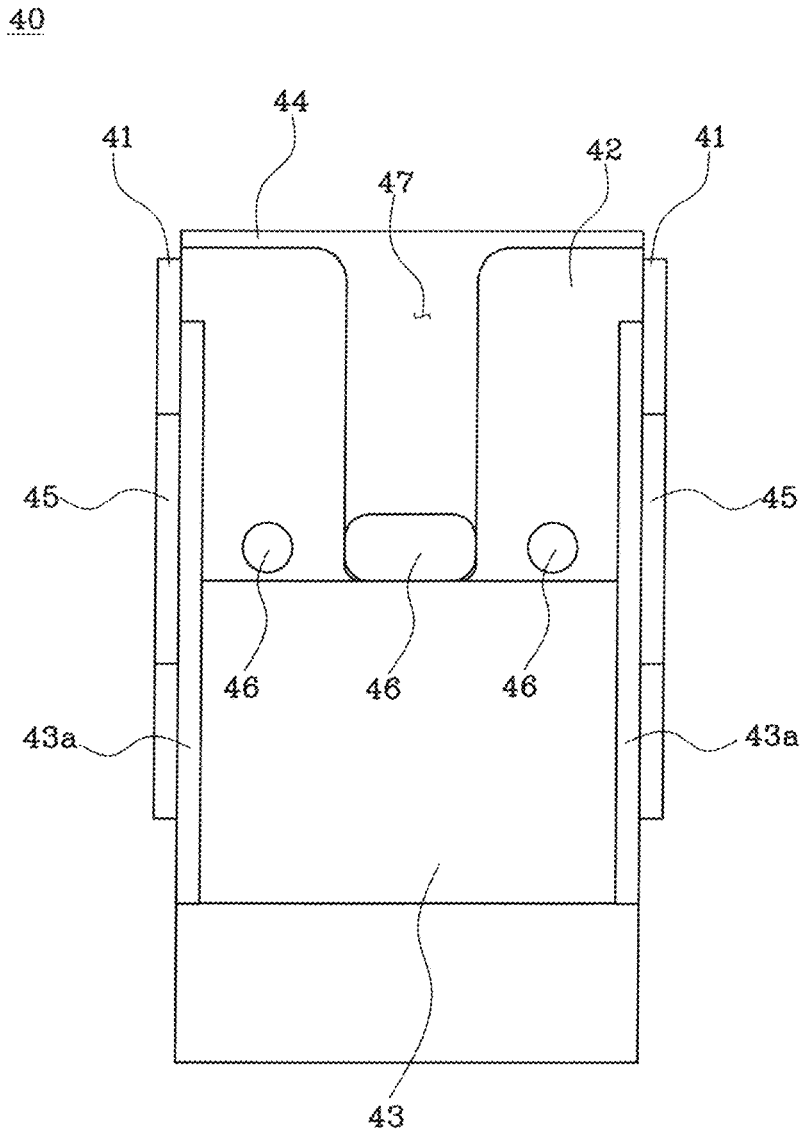
FIG. 7 is a front view of the first guide bracket according to embodiments of the present invention.
Figure 8:
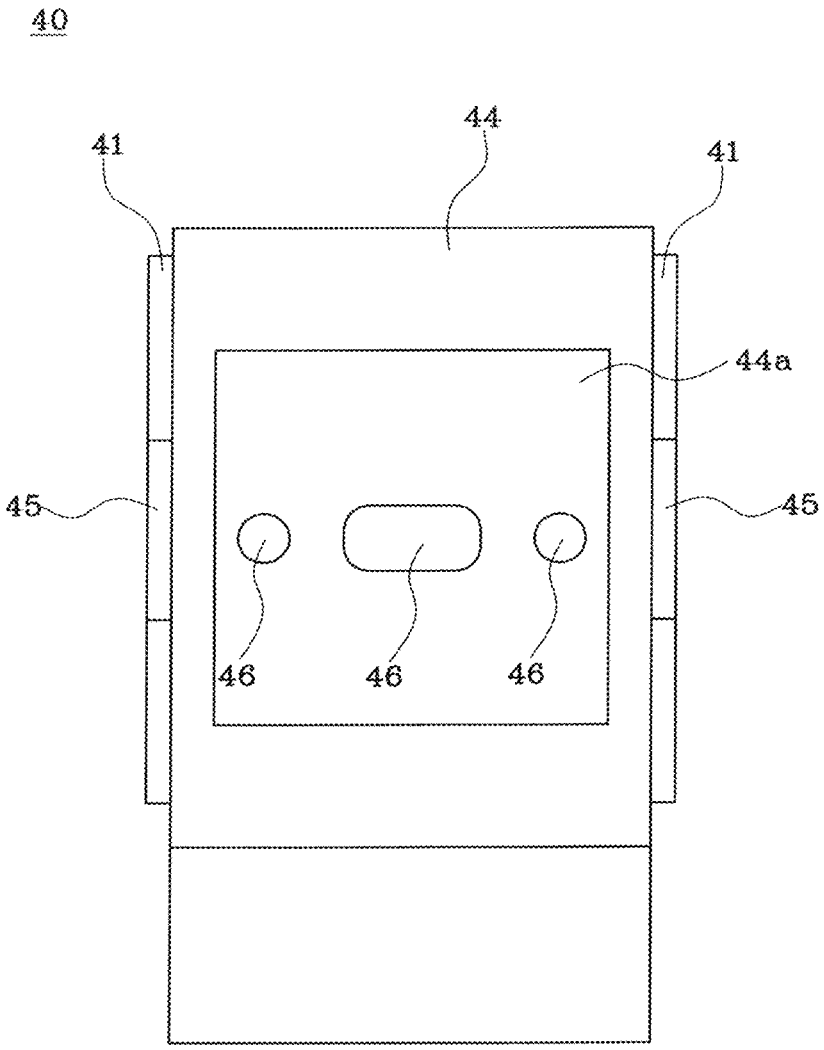
FIG. 8 is a rear view of the first guide bracket according to embodiments of the present invention.

FIGS. 4 to 8 are views for explaining detailed configurations of the first guide bracket 40 according to embodiments of the present invention. Specifically, FIG. 4 is a perspective view of the first guide bracket 40 according to embodiments of the present invention, FIG. 5 is an exploded view of the first guide bracket 40 according to embodiments of the present invention, FIG. 6 is a side view of the first guide bracket 40 according to embodiments of the present invention, FIG. 7 is a front view of the first guide bracket 40 according to embodiments of the present invention, and FIG. 8 is a rear view of the first guide bracket 40 according to embodiments of the present invention.

Referring to FIGS. 4 to 8, the first guide bracket 40 includes side plates 41, a first vertical plate 42, a rotating plate 43, and a second vertical plate 44.

As described above, the rear waling member 20 may be constituted by an upper waling member 22 and a lower waling member 24.

The side plate 41 is spaced a predetermined interval from each other to support the upper waling member 22 and the lower waling member 24 between the upper waling member 22 and the lower waling member 24, respectively. The side plates 41 may be provided as a pair to define both side surfaces of the first guide bracket 40. The side plates 41 may be spaced a predetermined interval from each other to support the upper waling member 22 and the lower waling member 24 between the upper waling member 22 and the lower waling member 24, respectively.

Here, a protrusion 45 may be disposed on each of both side surfaces of the side plates 41 to maintain a gap between the upper waling member 22 and the lower waling member 24. In addition, a pair of grooves 45*a* may be defined in top and bottom surfaces of the protrusion 45 on which the upper waling member 22 and the lower waling member 24 are seated, respectively. The flange of the upper waling member 22 and the flange of the lower waling member 24 may be seated in the grooves 45*a* defined in the top and bottom surfaces of the protrusion 45 to stably support the upper waling member 22 and the lower waling member 24, and also, a gap, through which the first tensile material 30 passes, may be defined between the upper waling member 22 and the lower waling member 24.

The first vertical plate 42 is disposed perpendicular to the pair of side plates 41, and the rotating plate 43 is disposed to protrude on one side of the first vertical plate 42, thereby changing the wiring direction of the first tensile material 30 to the direction perpendicular to the longitudinal direction of the rear pile 10. The first vertical plate 42 is disposed adjacent to the pair of side plates 41, and the rotary plate 43 may be disposed to protrude on one surface of the first vertical plate 42. The rotating plate 43 is provided in a curved shape to protrude so that, when the first tensile material 30 is in contact with the rotating plate 43, the wiring direction of the first tensile material 30 is changed due to the curved shape of the rotating plate 43. A separation prevention part 43*a* may be provided on each of both side surfaces of the rotating plate 43 to prevent the first tensile material 30 from being separated from the rotating plate 43. The separation prevention part 43*a* may be disposed to protrude in a direction perpendicular to the first vertical plate 42 on each of both the side surfaces of the rotating plate 43.

In addition, a plurality of holes 46 through which the first tensile material 30 passes and a plurality of grooves 47 may be defined in one surface of the first vertical plate 42. The first tensile material 30 may be wired so that the wiring direction is changed as it passes through the rear waling member 20 via the rotating plate 43 in the state of passing through the hole 46 or being seated in the groove 47.

The second vertical plate 44 is disposed parallel to the first vertical plate 42 to guide the first tensile material 30 toward the first front waling member 60. The second vertical plate 44 may be disposed adjacent to the pair of side plates 41 and may be disposed parallel to the first vertical plate 42. The plurality of holes 46 through which the first tensile material 30 passes may be defined in one surface of the second vertical plate 44. The holes 46 defined in one surface of the second vertical plate 44 may be defined at a position corresponding to the hole 46 and groove 47 of the first vertical plate 42. Here, an auxiliary plate 44*a* may be attached to the other surface of the second vertical plate 44. The auxiliary plate 44*a* may be attached to the other surface of the second vertical plate 44 to stably support the tension applied to the first guide bracket 40 by the first tensile material 30. The plurality of holes 46 may be defined in the auxiliary plate 44*a*, and the holes 46 of the auxiliary plate 44*a* may be defined at positions corresponding to the holes 46 of the second vertical plate 44.

As described above, the first tensile material 30 may be wired along the longitudinal direction of the rear pile 10, and when the first tensile material 30 is in contact with the rotating plate 43, the wiring direction may be changed to a direction perpendicular to the longitudinal direction of the rear pile 10, and then, the wiring direction may be guided by the holes 46 and grooves 47 of the first vertical plate 42 and the second vertical plate 44 to pass through the rear waling member 20. As described above, the first tensile material 30 may be wired along a longitudinal direction of the web in the state of being seated on a top surface of the web of the gap maintaining part 80 after passing through the rear waling member 20 to sequentially pass through the first front waling member 60 and the second guide bracket 70.

Figure 9:
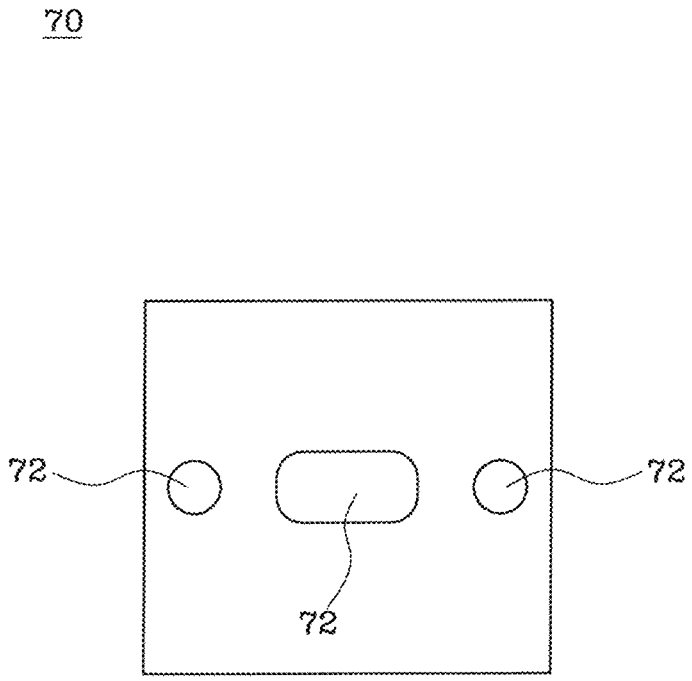
FIG. 9 is a front view of a second guide bracket according to embodiments of the present invention.
Figure 10:
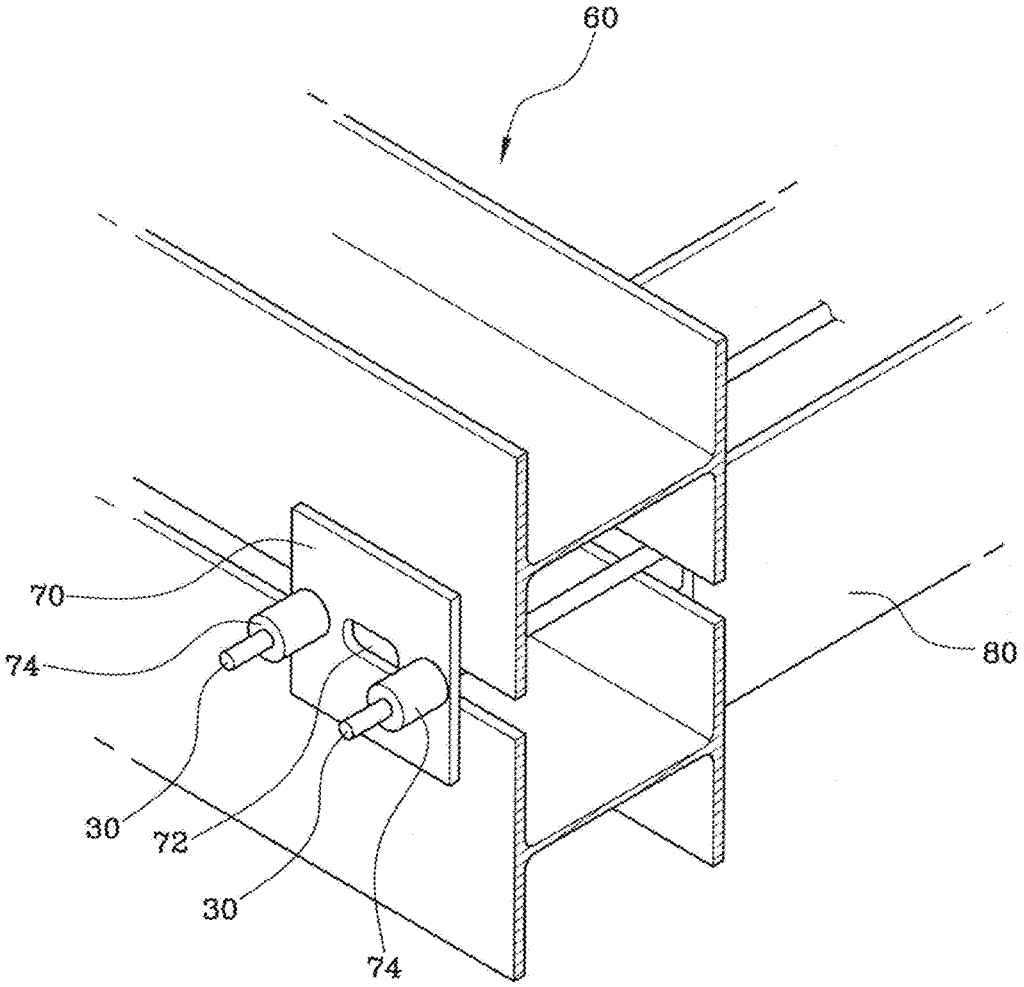
FIG. 10 is an exemplary view illustrating a state in which a first tensile material and the second guide bracket according to embodiments of the present invention.

FIG. 9 is a front view of the second guide bracket 70 according to embodiments of the present invention, and FIG. 10 is an exemplary view illustrating a state in which the first tension member 30 and the second guide bracket 70 according to embodiments of the present invention.

As illustrated in FIGS. 9 and 10, the plurality of holes 72 through which the first tensile material 30 passes may be defined in the second guide bracket 70.

As described above, the second guide bracket 70 may be provided in a plate shape having a predetermined size and be coupled to the first front waling member 60, and the first tensile material 30 may pass through the second guide bracket 70 via the first front waling member 60 to pass through the holes 72. In addition, the fixing member 74 for fixing the first tensile material 30 may be provided in the hole of the second guide bracket 70.

Figure 11:
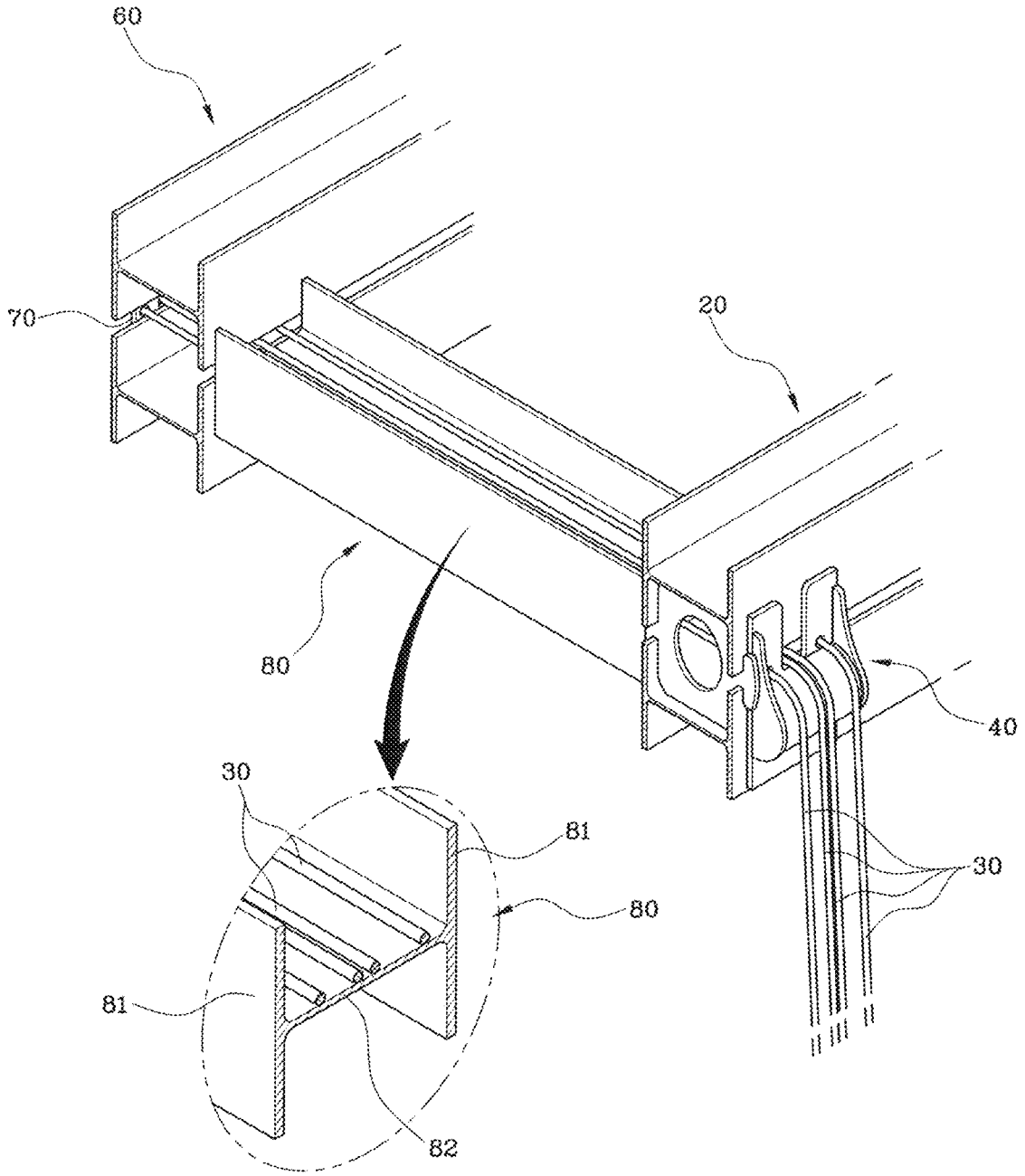
FIG. 11 is a view for explaining a gap maintaining part according to embodiments of the present invention.

FIG. 11 is a view for explaining the gap maintaining part 80 according to embodiments of the present invention. As described above, the gap maintaining part 80 is disposed between the rear waling member 20 and the first front waling member 60 to support each of the rear waling member 20 and the first front waling member 60, thereby maintaining a gap between the rear waling member 20 and the first front waling member 60.

Referring to FIG. 11, the gap maintaining part 80 may be provided in an H-beam shape constituted by a plurality of flanges 81 and webs 82. As described above, the first tensile material 30 may be wired along a longitudinal direction of the web 82 in the state of being seated on a top surface of the web 82 to sequentially pass through the first front waling member 60 and the second guide bracket 70.

Figure 12:
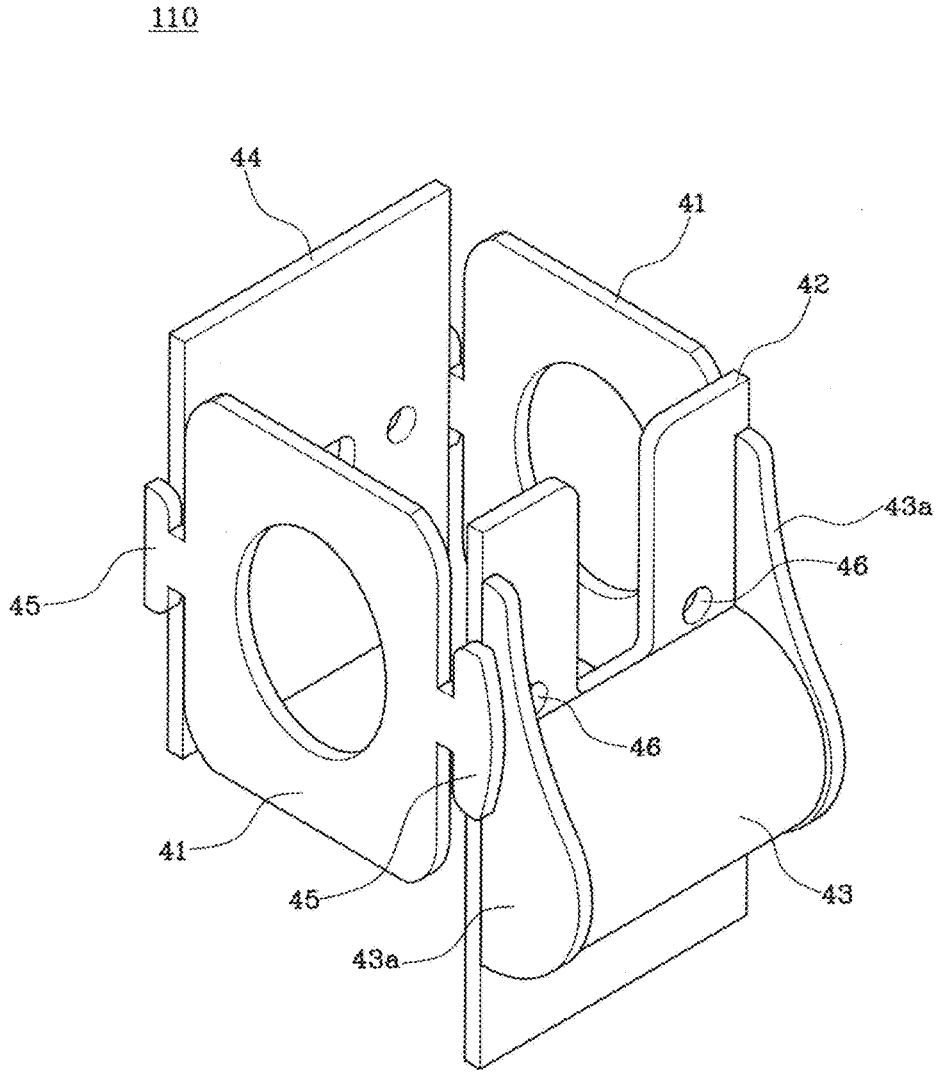
FIG. 12 is a front view of a third guide bracket according to embodiments of the present invention.

FIG. 12 is a front view of the third guide bracket 110 according to embodiments of the present invention. As described above, the third guide bracket 110 has the same structure and shape as the first guide bracket 40. Thus, the third guide bracket 110 may include side plates 41, a first vertical plate 42, a rotating plate 43, and a second vertical plate 44, and detailed configurations thereof has been described detail above, and thus, detailed descriptions thereof will be omitted below.

Like the first tensile material 30 described above, the second tensile material 100 may be wired along the longitudinal direction of the front pile 50, and when the second tensile material 100 is in contact with the rotating plate 43, the wiring direction may be changed to a direction perpendicular to the longitudinal direction of the front pile 50, and then, the wiring direction may be guided by the holes 46 and grooves 47 of the first vertical plate 42 and the second vertical plate 44 to pass through the second front waling member 90.

As described above, the second tensile material 100 may have one end, which passes through the second front waling member 90 via the third guide bracket 110 to protrude to a front surface of the third guide bracket 110, and the other end fixed to the lower portion of the ground that is first-stage excavated. Here, the other end of the second tensile material 100 may be fixed by being grouted in the SCW front fixing manner described above.

Figure 13:
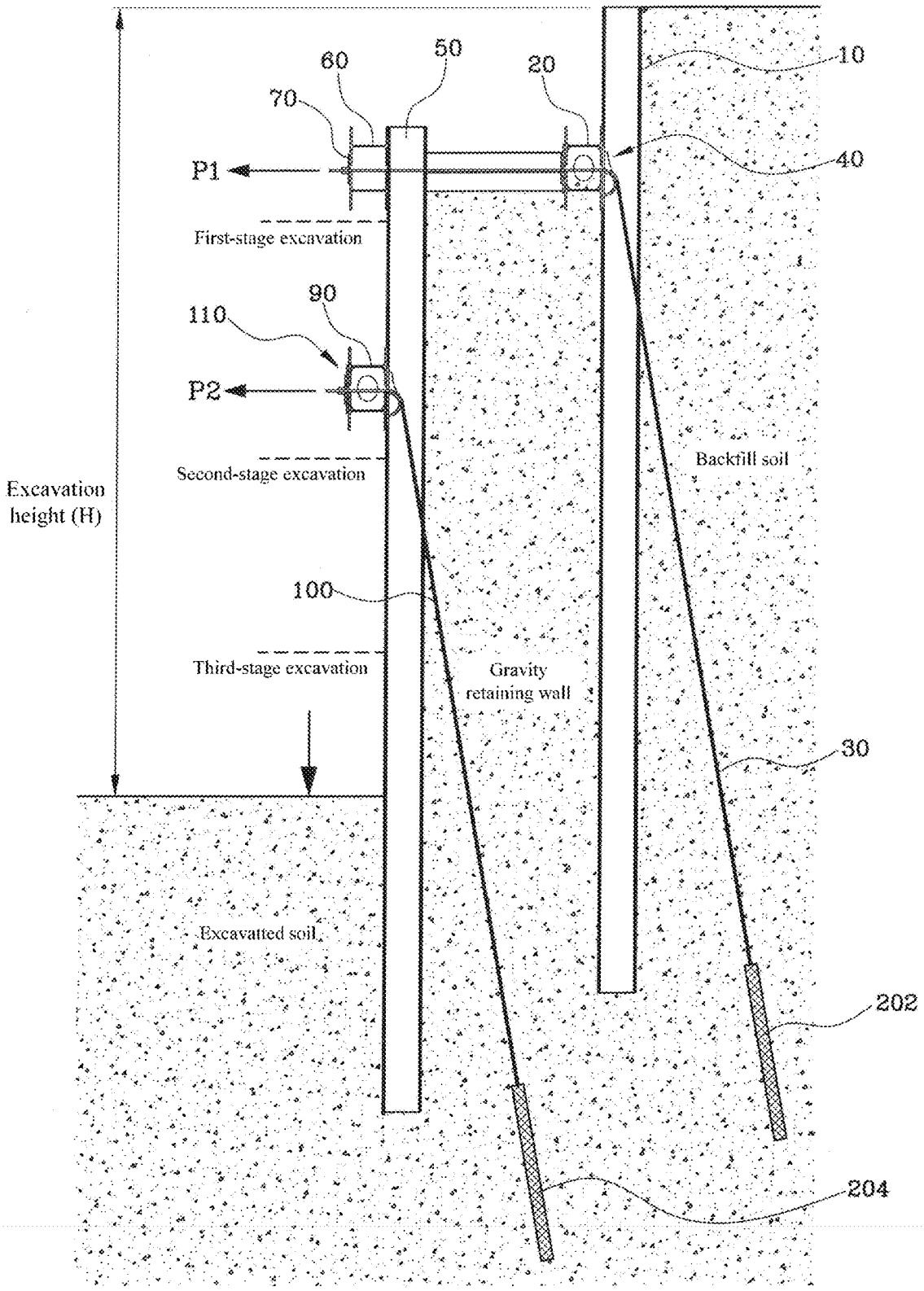
FIG. 13 is a side view of a two-row self-supporting temporary earth retaining structure according to another embodiment of the present invention.
Figure 14:
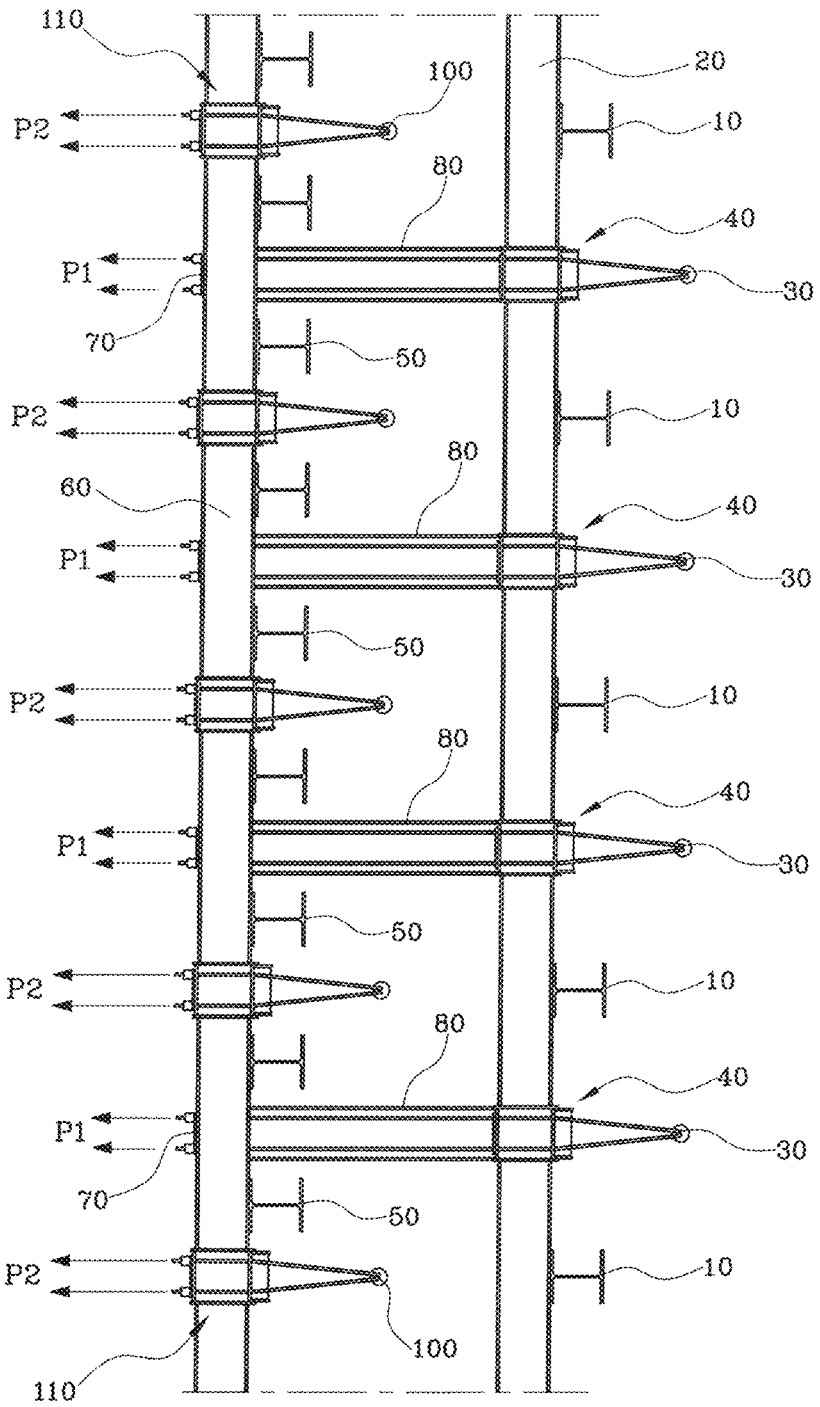
FIG. 14 is a plan view of the two-row self-supporting temporary earth retaining structure according to another embodiment of the present invention.

FIG. 13 is a side view of a two-row self-supporting temporary earth retaining structure 1 according to another embodiment of the present invention, and FIG. 14 is a plan view of the two-row self-supporting temporary earth retaining structure 1 according to another embodiment of the present invention.

In the case of the two-row self-supporting earth retaining structure 1 according to another embodiment of the present invention, which is illustrated in FIGS. 13 and 14, the remaining configurations are the same as the foregoing embodiment except for only differences in manner in which the other end of a first tensile material 30 and the other end of a second tensile material 100 are fixed.

In the case of the two-row self-supporting earth retaining structure 1 according to another embodiment of the present invention illustrated in FIGS. 13 and 14, the other end of the first tensile material 30 and the other end of the second tensile material 100 may be fixed by a first ground anchor 202 and a second ground anchor 204, respectively.

The first ground anchor 202 and the second ground anchor 204 are devices that provide tensile force to a rear pile 10 and a front pile 50 so that the rear pile 10 and the front pile 50 have resistance to an earth pressure of backfill soil. A fixing agent is provided at ends of the first ground anchor 202 and the second ground anchor 204, and the fixing agent is fixed obliquely at a predetermined angle with respect to each of the rear pile 10 and the front pile 50. Thus, in FIGS. 13 and 14, it is confirmed that the first tensile material 30 and the second tensile material 100 are not wired parallel to a longitudinal direction of the rear pile 10 and the front pile 50, but are wired obliquely while angled at a predetermined angle with each of the rear pile 10 and the front pile 50.

Figure 15:
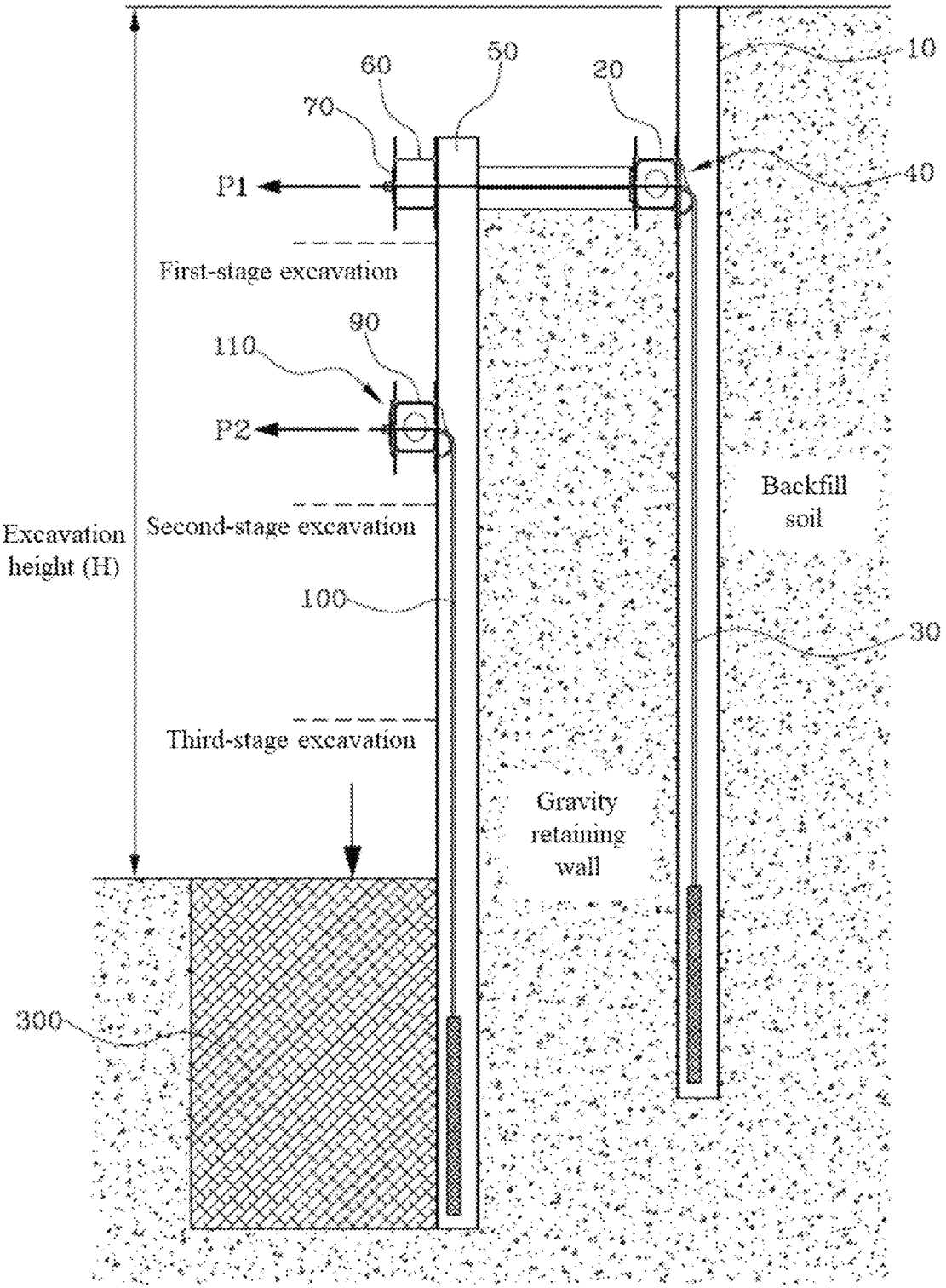
FIG. 15 is a view illustrating an example in which a passive resistance block body is grouted according to embodiments of the present invention.

FIG. 15 is a view illustrating an example in which a passive resistance block body 300 is grouted according to embodiments of the present invention.

Referring to FIG. 15, the passive resistance block 300 may be grouted and fixed to a lower portion of the front pile 50 so as to be adjacent to the front pile 50 to support the front pile 50.

The passive resistance block 300 may be grouted to be adjacent to the front pile 50 at the lower portion of the front pile 50 (i.e., lower portion of (N-th)-stage excavated ground) using, for example, an underground cutting injection (UCI) method, a jumbo special pile (JSP) method, etc. Thus, the lower portion of the front pile 50 may be supported by the passive resistance block 300 to more reinforce stability. The passive resistance block 300 may be provided as, for example, a block having a thickness of about 3 m and a width of about 5 m, but the size, shape, etc. of the passive resistance block 300 are not particularly limited.

Figure 16:
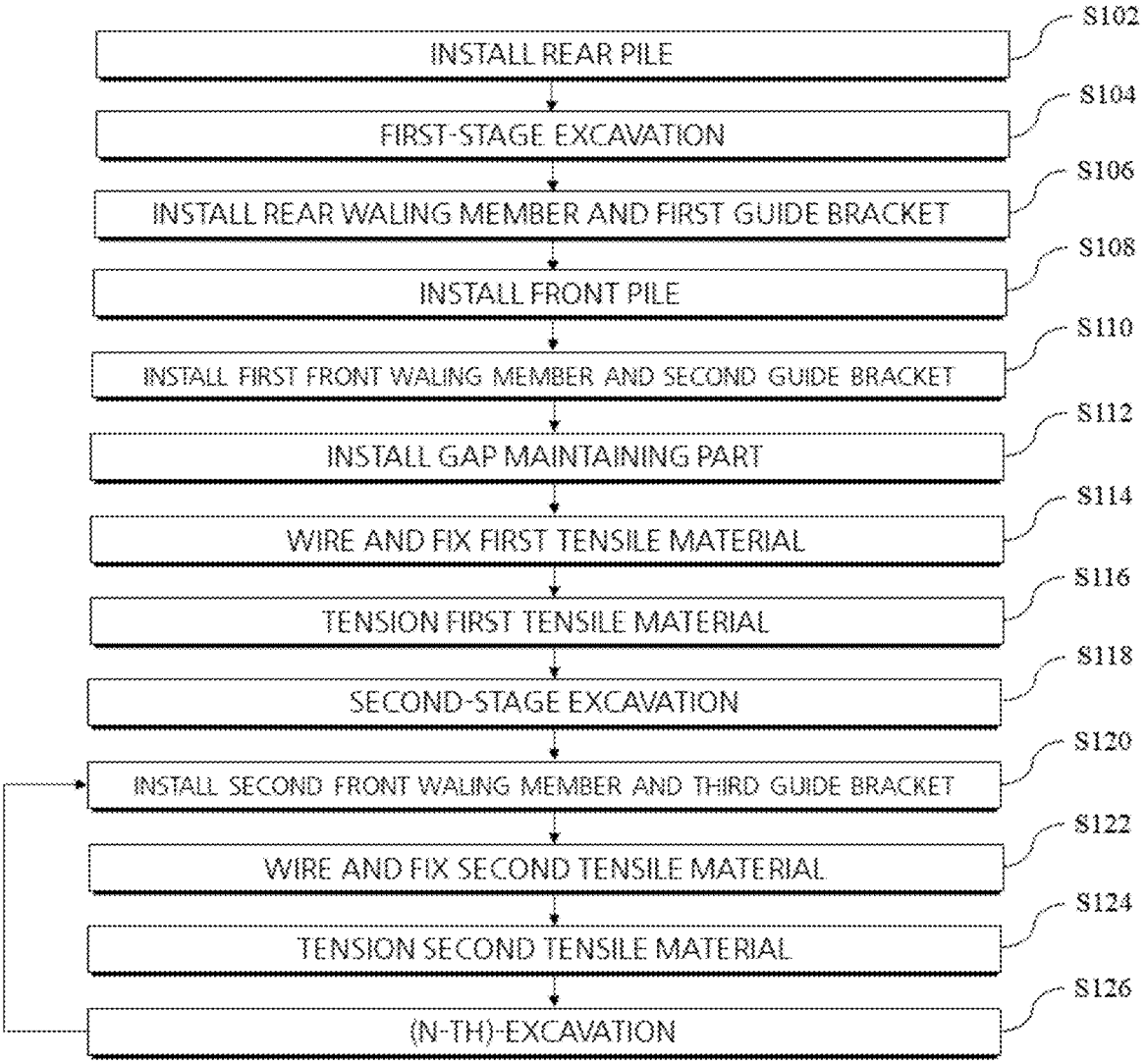
FIG. 16 is a flowchart for explaining a method for constructing a two-row self-supporting temporary earth retaining structure according to embodiments of the present invention.

FIG. 16 is a flowchart for explaining a method for constructing a two-row self-supporting temporary earth retaining structure 1 according to embodiments of the present invention. Although the method is described as being divided into a plurality of steps in the illustrated flowchart, at least some of the steps may be performed in a different order, combined with other steps to be performed together, omitted, or divided into sub-steps to be performed, or one or more steps not illustrated may be added and performed.

In operation S102, a plurality of rear piles 10 are installed.

In operation S104, a first-stage excavation is performed to a predetermined depth at an opposite side of backfill soil.

In operation S106, a rear waling member 20 and a first guide bracket 40 are installed.

In operation S108, a plurality of front piles 50 are installed.

In operation S110, a front waling member 60 and a second guide bracket 70 are installed.

In operation S112, a gap maintaining member 80 is installed between the rear waling member 20 and the first front waling member 60.

In operation S114, a plurality of first tensile materials 30 are wired and then fixed.

In operation S116, the plurality of first tensile materials 30 are tensioned.

In operation S118, a second-stage excavation is performed to a depth deeper than that of the first-stage excavation below the first front waling member 60.

In operation S120, a second front waling member 90 and a third guide bracket 110 are installed.

In operation S122, a plurality of second tensile materials 100 are wired and then fixed.

In operation S124, the plurality of second tensile materials 100 are tensioned.

In operation S126, (N-th)-stage excavation (e.g., third-stage excavation) is performed to a depth deeper than that of the second-stage excavated ground below the second front waling member 90. Thereafter, the operations S120 to S124 are repeatedly performed until the excavation depth reaches a target depth.

Although the present invention has been described above in detail through representative embodiments, those skilled in the art will understand that various modifications can be made to the above-described embodiments without departing from the scope of the present invention. Therefore, the scope of the present invention should not be limited to the described embodiments, but should be defined not only by the claims described below but also by equivalents of the claims.

What is claimed is:

1. A two-row self-supporting earth retaining wall structure comprising:

a plurality of rear piles spaced a predetermined interval from backfill soil while adjacent to the backfill soil and installed vertically with respect to the ground;

a rear waling member disposed adjacent to the plurality of rear piles in a direction perpendicular to the plurality of rear piles at an upper portion of the ground, which is first-stage excavated, after the first-stage excavation is performed to a predetermined depth at an opposite side of the backfill soil;

a first guide bracket coupled to the rear waling member and configured to change a wiring direction of a plurality of first tensile materials to a direction perpendicular to a longitudinal direction of the rear pile so that the first tensile materials are guided to pass through the rear waling member;

a plurality of front piles spaced a predetermined interval from the plurality rear piles and installed vertically with respect to the first-stage excavated ground;

a first front waling member disposed adjacent to the plurality of front piles in a direction perpendicular to the plurality of front piles at an upper side of the first-stage excavated ground;

a second guide bracket coupled to the first waling member to guide the plurality of first tensile materials so as to pass through the first waling member and to fix the first tensile materials that passes through the first front waling member;

a second front waling member disposed adjacent to the plurality of front piles in a direction perpendicular to the plurality of front piles at an upper side of the second-stage excavated ground after the second-stage excavation is completed to a depth deeper than that of the first-stage excavation to a lower side of the first front waling member in a state in which one end of each of the first tensile materials is tensioned; and a third guide bracket coupled to the second front waling member to change a wiring direction of a plurality of second tensile materials to a direction perpendicular to a longitudinal direction of each of the front piles so that the second tensile materials are guided to pass through the second front waling member, wherein each of the plurality of first tensile materials has one end, which passes through the second guide bracket to protrudes to a front surface of the second guide bracket, and the other end fixed to a lower portion of the ground, and the one end of each of the first tensile materials is tensioned in the state in which the other end of each of the first tensile materials is fixed to the lower portion of the ground, wherein the rear waling member comprises:

an upper waling member; and a lower waling member disposed to be spaced a predetermined interval from the upper waling member at a lower side of the upper waling member, wherein the first guide bracket comprises:

a pair of side plates spaced a predetermined interval from each other between the upper waling member and the lower waling member to support the upper waling member and the lower waling member, respectively;

a first vertical plate disposed perpendicular to the pair of side plates and provided with a rotating plate protruding on one surface thereof to change the wiring direction of the first tensile material to the direction perpendicular to the longitudinal direction of the rear pile; and a second vertical plate disposed parallel to the first vertical plate so that the first tensile material is guided toward the first front waling member.

2. The two-row self-supporting earth retaining wall structure of claim 1, wherein a gap maintaining member configured to support the rear waling member and the first front waling member so as to maintain a gap between the rear waling member and the first front waling member is disposed between the rear waling member and the first waling member, the gap maintaining member is provided in an H-beam shape constituted by a plurality of flanges and a web, and the plurality of first tensile materials are wired along a longitudinal direction of the web in a state of being seated on a top surface of the web to pass through the first front waling member.

3. The two-row self-supporting earth retaining wall structure of claim 1, wherein each of the plurality of second tensile materials has one end, which passes through the second front waling member to protrude, and the other end fixed to a lower portion of the first-stage excavated ground, and one end of each of the second tensile materials is tensioned in the state in which the other end of each of the second tensile materials is fixed to the lower portion of the first-stage excavated ground.

4. The two-row self-supporting earth retaining wall structure of claim 3, wherein each of the second front waling member and the third guide bracket is disposed at an upper portion of an (N-th)-stage excavated ground whenever (N-th)-stage excavation is completed to a depth deeper than that of the second-stage excavated ground to a lower side of the second front waling member.

5. The two-row self-supporting earth retaining wall structure of claim 3, wherein the other end of the first tensile material and the other end of the second tensile material are fixed by a first ground anchor and a second ground anchor, respectively.

6. The two-row self-supporting earth retaining wall structure of claim 1, wherein a protrusion configured to maintain a gap between the upper waling member and the lower waling member protrudes from each of both side surfaces of the side plate, and a pair of grooves in which the upper waling member and the lower waling member are seated, respectively, are defined in top and bottom surfaces of the protrusion.

7. The two-row self-supporting earth retaining wall structure of claim 1, wherein a plurality of holes through which the first tensile material passes are defined in one surface of each of the first vertical plate and the second vertical plate.

8. The two-row self-supporting earth retaining wall structure of claim 1, wherein a passive resistance block body disposed adjacent to the front pile to support the front pile is grouted to be fixed is disposed at a lower portion of the front pile.

* * * * *